US008763383B2

(12) United States Patent
Zuccone

(10) Patent No.: US 8,763,383 B2
(45) Date of Patent: Jul. 1, 2014

(54) EXHAUST FLOW DIVIDER

(75) Inventor: Todd M. Zuccone, Fountain Hills, AZ (US)

(73) Assignee: Evolution Motorsports, Tempe, AZ (US)

( * ) Notice: Subject to any disclaimer, the term of this patent is extended or adjusted under 35 U.S.C. 154(b) by 303 days.

(21) Appl. No.: 13/292,768

(22) Filed: Nov. 9, 2011

(65) Prior Publication Data

US 2012/0117944 A1 May 17, 2012

Related U.S. Application Data

(60) Provisional application No. 61/414,716, filed on Nov. 17, 2010.

(51) Int. Cl.

| | |
|---|---|
| ***F01N 1/00*** | (2006.01) |
| ***F01N 3/00*** | (2006.01) |
| ***F01N 3/02*** | (2006.01) |
| ***F01N 3/20*** | (2006.01) |

(52) U.S. Cl.
USPC ..... 60/323; 60/324

(58) Field of Classification Search
USPC ..... 60/323, 324
See application file for complete search history.

(56) References Cited

U.S. PATENT DOCUMENTS

| | | | | |
|---|---|---|---|---|
| 5,560,326 | A * | 10/1996 | Merritt | 123/51 AA |
| 8,117,835 | B2 * | 2/2012 | Mori | 60/304 |
| 2008/0053066 | A1 * | 3/2008 | Nakagome et al. | 60/276 |
| 2008/0265524 | A1 * | 10/2008 | Mori | 277/595 |
| 2009/0266065 | A1 * | 10/2009 | Barrieu et al. | 60/323 |
| 2010/0186396 | A1 * | 7/2010 | Rippert et al. | 60/317 |
| 2012/0266588 | A1 * | 10/2012 | Riekers et al. | 60/323 |

* cited by examiner

*Primary Examiner* — Kenneth Bomberg
*Assistant Examiner* — Dapinder Singh
(74) *Attorney, Agent, or Firm* — Schwegman, Lundberg & Woessner, P.A.

(57) ABSTRACT

An exhaust flow divider is interposed between a head and an exhaust manifold of an internal combustion engine. The exhaust flow divider may be configured to maintain separation between two exhaust streams flowing from a cylinder of the engine through the head until, e.g., the exhaust exits the head and flows into the exhaust manifold.

17 Claims, 6 Drawing Sheets

EXHAUST FLOW DIVIDER

This application claims the benefit of U.S. Provisional Application No. 61/414,716, filed Nov. 17, 2010, which is hereby incorporated by reference in its entirety.

TECHNICAL FIELD

This disclosure relates to exhaust gas flow in internal combustion engines.

BACKGROUND

Internal combustion engines, including, e.g., automobiles engines commonly include a head connected to the engine block and through which intake air is mixed with gas and ignited in cylinders in the block to drive pistons in the cylinders to turn a crank shaft. The products of combustion are also exhausted through the head after ignition and directed from the head into an exhaust manifold before flowing through the exhaust train of the vehicle and out, e.g., the tail pipe. Modern automobile engines commonly include multiple intake and exhaust ports opened and closed via multiple valves driven by one or more camshafts. Such engines are sometimes referred to as dual overhead cams (DOHC) or quattrovalve engines. On the exhaust side of the engine cycle, the manner in which the combustion products from each of multiple ports from a cylinder meet and mix with one another before being exhausted from the engine can affect the power and efficiency of the engine. As such, optimizing flow conditions and reducing back pressure of the combustion products exhausted from an internal combustion engine are important design criteria for modern automobile engines.

SUMMARY

In general, this disclosure is directed to devices and methods for maintaining separation between multiple streams of exhaust flowing out of a cylinder and through a head of an internal combustion engine. In one example, an internal combustion engine includes a cylinder, a head, an exhaust manifold, and an exhaust flow divider. The head is connected to the cylinder and includes at least two flow paths between the cylinder and the head that meet within a chamber of the head at a saddle. The exhaust manifold is connected to the head. The exhaust flow divider includes a mounting plate and a flow divider plate. The mounting plate is interposed between the head and the exhaust manifold and includes an aperture aligned with an aperture in the exhaust manifold. The flow divider plate is connected to the mounting plate such that the flow divider plate spans the aperture in the mounting plate and protrudes from the mounting plate into the chamber within the head such that the flow divider extends at least two of the at least two flow paths from the saddle toward the exhaust manifold.

In another example, an exhaust flow divider for an internal combustion engine includes a mounting plate and a flow divider plate. The mounting plate is configured to be interposed between a head and an exhaust manifold of the engine and includes an aperture configured to be aligned with an aperture in the exhaust manifold. The flow divider plate is connected to the mounting plate such that the flow divider plate spans the aperture in the mounting plate.

In another example, a method includes separating exhaust within a head of an internal combustion engine into at least two streams from at least two cylinder exhaust ports of the engine, directing the at least two separated exhaust streams through the head, and mixing the at least two separated exhaust streams into one stream after the at least two streams flow out of the head into an exhaust manifold of the engine.

The details of one or more examples of this disclosure are set forth in the accompanying drawings and the description below. Other features, objects, and advantages of examples in accordance with this disclosure will be apparent from the description and drawings, and from the claims.

DETAILED DESCRIPTION

The following examples include an exhaust flow divider interposed between a head and an exhaust manifold of an internal combustion engine. The exhaust flow divider may be configured to maintain separation between two exhaust streams flowing from a cylinder of the engine through the head until, e.g., the exhaust exits the head and flows into the exhaust manifold.

Figure 1:
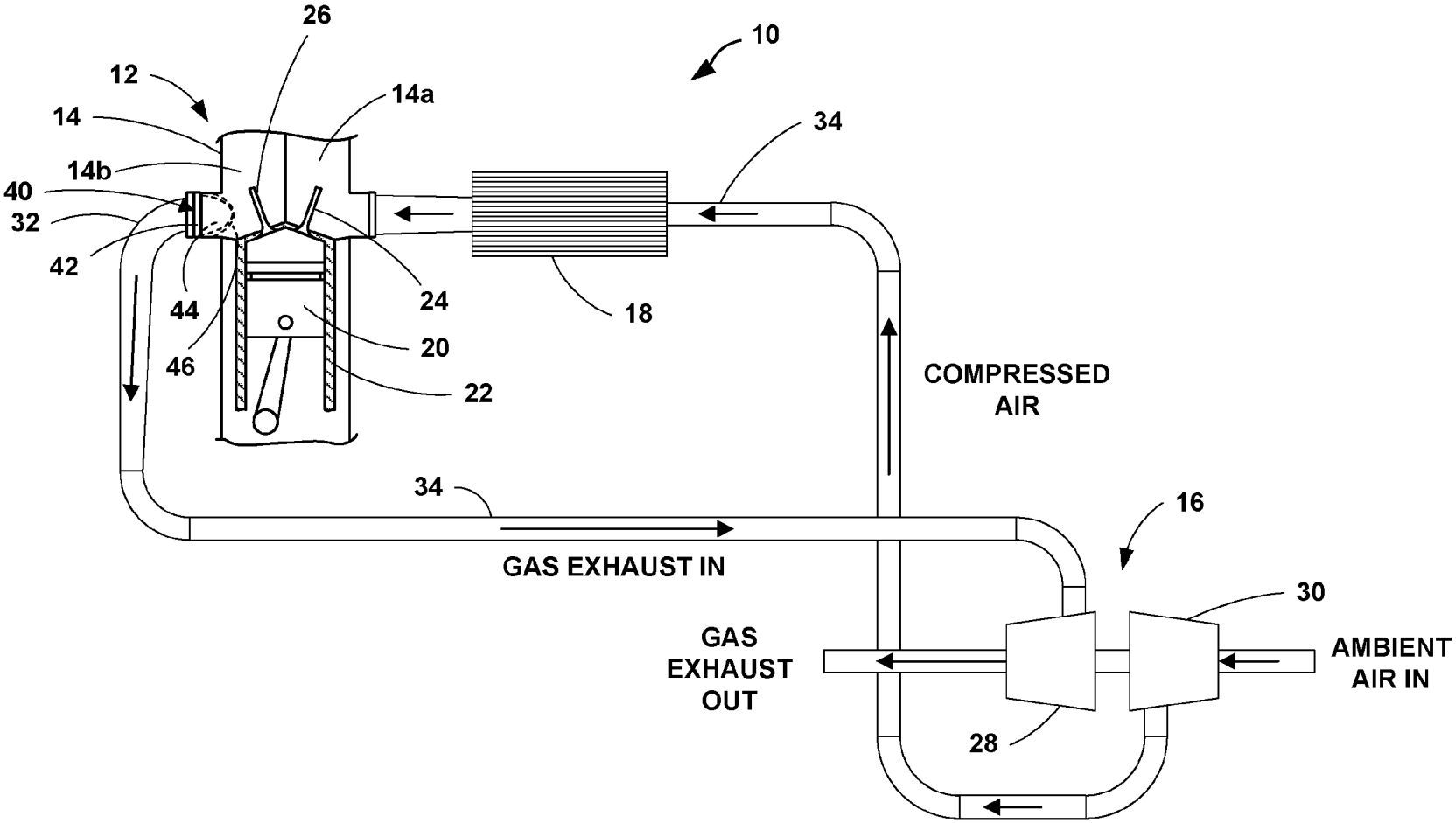
FIG. 1 is a schematic illustration of an internal combustion engine including an example exhaust flow divider.

FIG. 1 is a schematic illustration of internal combustion engine 10 including engine block 12, head 14, turbocharger 16, and intercooler 18. In FIG. 1, engine block 12 includes piston 20 and cylinder 22. Head 14 includes intake side 14*a* and intake valve 24, exhaust side 14*b* and exhaust valve 26. Although only one cylinder 22 is shown in FIG. 1 for illustrative purposes, engine 10 may and commonly will include multiple cylinders, including, e.g. four, six, or eight cylinders. Additionally, although not visible in the view of FIG. 1, engine 10 may include multiple intake and exhaust valves, e.g. two intake valves and two exhaust valves for each cylinder 22, which is sometimes referred to as a quattrovalve engine. Turbocharger 16 includes turbine 28 and compressor 30. The inlet of turbocharger 16 is connected to exhaust manifold 32 via conduit 34. Similarly, the outlet of turbocharger 16 is connected to intercooler 18, which is connected to intake side 14*a* of head 14.

In one example, engine 10 includes a four stroke configuration, common to automobiles and light aircraft, by which piston 20 has one power stroke per four strokes of the complete power and exhaust cycle of the engine. In particular, the four stroke cycle of engine 10 may include an intake stroke, compression stroke, combustion (power) stroke, and exhaust stroke. During the intake stroke of engine 10, air and vaporized fuel are drawn into intake side 14*a* of head 14 and intake valve 24 opens to permit the fuel and air mixture to enter cylinder 22 through an intake port in the head. Piston 20 is in a retracted position in cylinder 22 during the intake stroke such that the piston is closer to the crank shaft (not shown in FIG. 1). During the compression stroke of engine 10, cylinder the fuel and air mixture are compressed by the action of piston 20 within cylinder 22 as the piston moves farther away from the crank shaft and closer to head 14. The compressed fuel and air mixture is then ignited within cylinder 22 by, e.g., a spark plug (not shown in FIG. 1). The combustion stroke includes the combustion of the vaporized fuel and air mixture within cylinder 22, which, in turn, drives piston 20 back to a retracted position closer to the crank shaft and further from head 14. The last stroke in the four stroke cycle, the exhaust stroke, includes piston 20 returning to an extended position farther away from the crank shaft and closer to head 14 within cylinder 22 and exhaust valve 26 opening. As piston 20 moves to the extended position within cylinder 22, the products of combustion, i.e. exhaust are pushed out of the cylinder through an exhaust port accessible via exhaust valve 26 opening. The exhaust flows through exhaust side 14*a* of the head into exhaust manifold 32. During the $1^{st}$, intake, $2^{nd}$, compression, and $4^{th}$, exhaust, strokes piston 20 is relying on power and momentum generated by the other pistons (not visible in the view of FIG. 1) of engine 10.

In some examples, like the example of FIG. 1, engine 10 may include turbocharger 16 to increase power output by supplying, instead of ambient air, compressed air to the intake side of the engine cycle. In such examples, the exhaust drives turbine 28 of turbocharger 16 after exiting exhaust side 14*a* of head 14 via exhaust manifold 32. Turbine 28 spins compressor 30, which draws in and compresses ambient air to be transmitted through conduit 34 to intercooler 18. The compressed air from turbocharger 16 is cooled in intercooler 18 before being transmitted to intake side 14*a* of head 14, in which it is mixed with fuel during the intake stroke of another cycle of engine 10.

As noted above, although only one cylinder 22 is shown in FIG. 1 for illustrative purposes, engine 10 may and commonly will include multiple cylinders, including, e.g. four, six, or eight cylinders. Additionally, although not visible in the view of FIG. 1, engine 10 may include, e.g. two intake valves and two exhaust valves for each cylinder 22, which is sometimes referred to as a quattrovalve engine. Each of the intake and exhaust valves of each cylinder 22 may be actuated by a camshaft (not shown) to open and close intake and exhaust ports in the cylinder. With reference to the exhaust side of engine 10, therefore, for each cylinder 22 of the engine, exhaust side 14*b* of head may include a flow path out of the cylinder into the head via each of two exhaust ports accessible via two exhaust valves 26 (only one visible in view of FIG. 1) opening. In one example, the flow paths of exhaust side 14*b* of head 14 may be defined by inlet apertures aligned with the exhaust ports of cylinder 22 and one outlet aperture aligned with an inlet aperture of exhaust manifold 32. The flow of exhaust through exhaust side 14*b* of head 14 may exit cylinder 22 through the two exhaust ports and flow in two separate streams along the two flow paths in the head. The two flow paths in exhaust side 14*b* of head 14 meet at saddle 46 within a chamber of the head.

As will be discussed in greater detail with reference to FIGS. 5A and 5B, it may be disadvantageous for the two exhaust streams flowing along the two flow paths of exhaust side 14*b* of head 14 to meet and mix at saddle 46 in some examples of engine 10. Examples according to this disclosure therefore include exhaust flow divider 40 interposed between exhaust side 14*b* of head 14 and exhaust manifold 32. Exhaust flow divider 40 may act to maintain separation between the two exhaust streams flowing from cylinder 22 through exhaust side 14*b* of head 14 until, e.g., the exhaust exits the head and flows into exhaust manifold 32.

Exhaust flow divider 40 includes mounting plate 42 and one flow divider plate 44 for each cylinder 22 of engine 10. Mounting plate 42 is interposed between exhaust side 14*b* of head 14 and exhaust manifold 32. As will be described and illustrated with reference to FIGS. 2-5B, mounting plate 42 includes an aperture for each cylinder 22, which is configured to be aligned with an aperture in exhaust manifold 32. Flow divider plate 44 is connected to mounting plate 42 such that the flow divider plate spans the aperture in the mounting plate. Flow divider plate 44 protrudes from mounting plate 42 into a chamber within exhaust side 14*b* of head 14 such that the flow divider extends the two flow paths from saddle 46 toward exhaust manifold 32. The end of flow divider plate 44 protruding into the chamber of exhaust side 14*b* of head 14 may be shaped to be received by saddle 46. In the example of FIG. 1, the end of flow divider plate 44 protruding into the chamber of exhaust side 14*b* of head 14 includes a generally convex shape and saddle 46 includes a generally concave shape. In another example, however, the end of flow divider plate 44 protruding into the chamber of exhaust side 14*b* of head 14 may include a generally concave shape and saddle 46 may include a generally convex shape.

Figure 2:
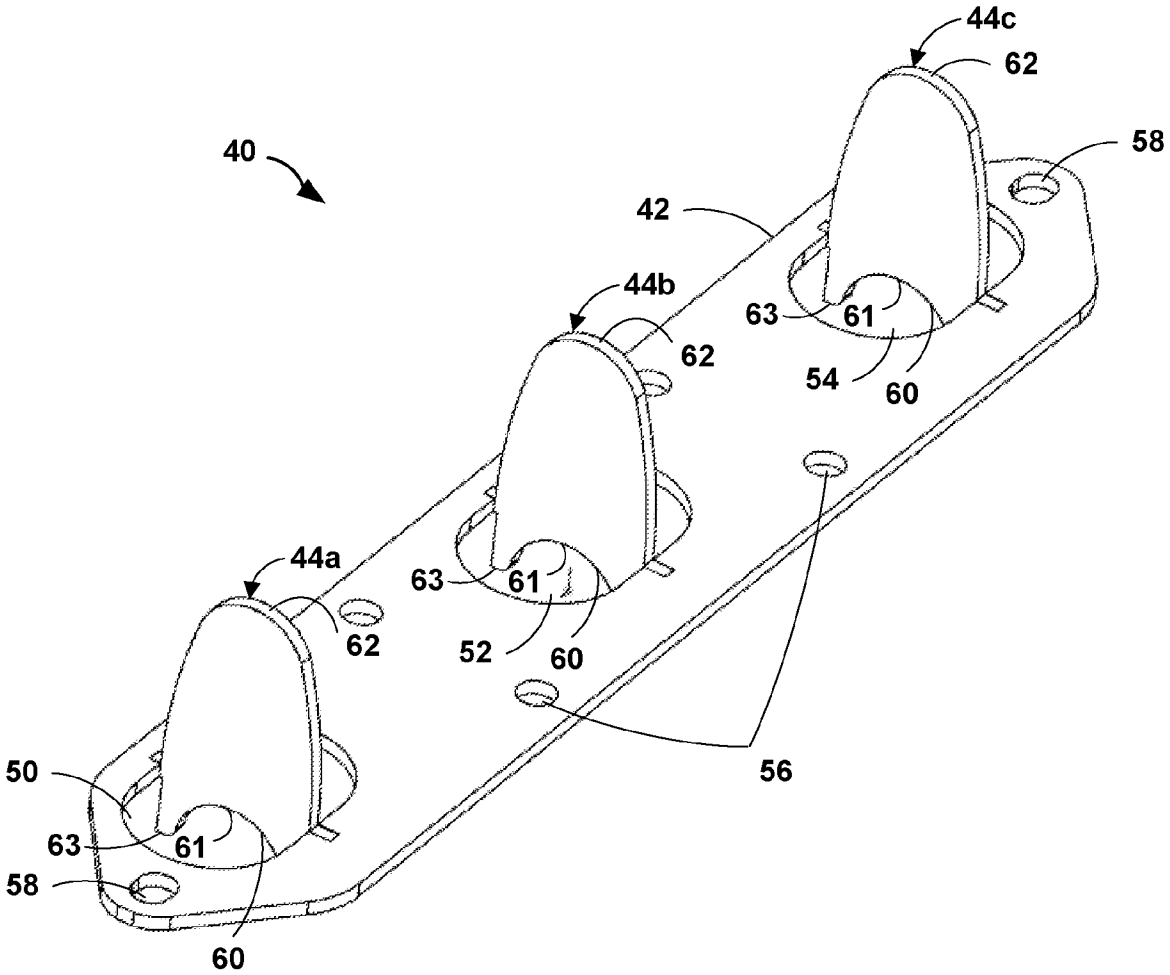
FIG. 2 is a perspective view of the exhaust flow divider of FIG. 1.
Figure 3:
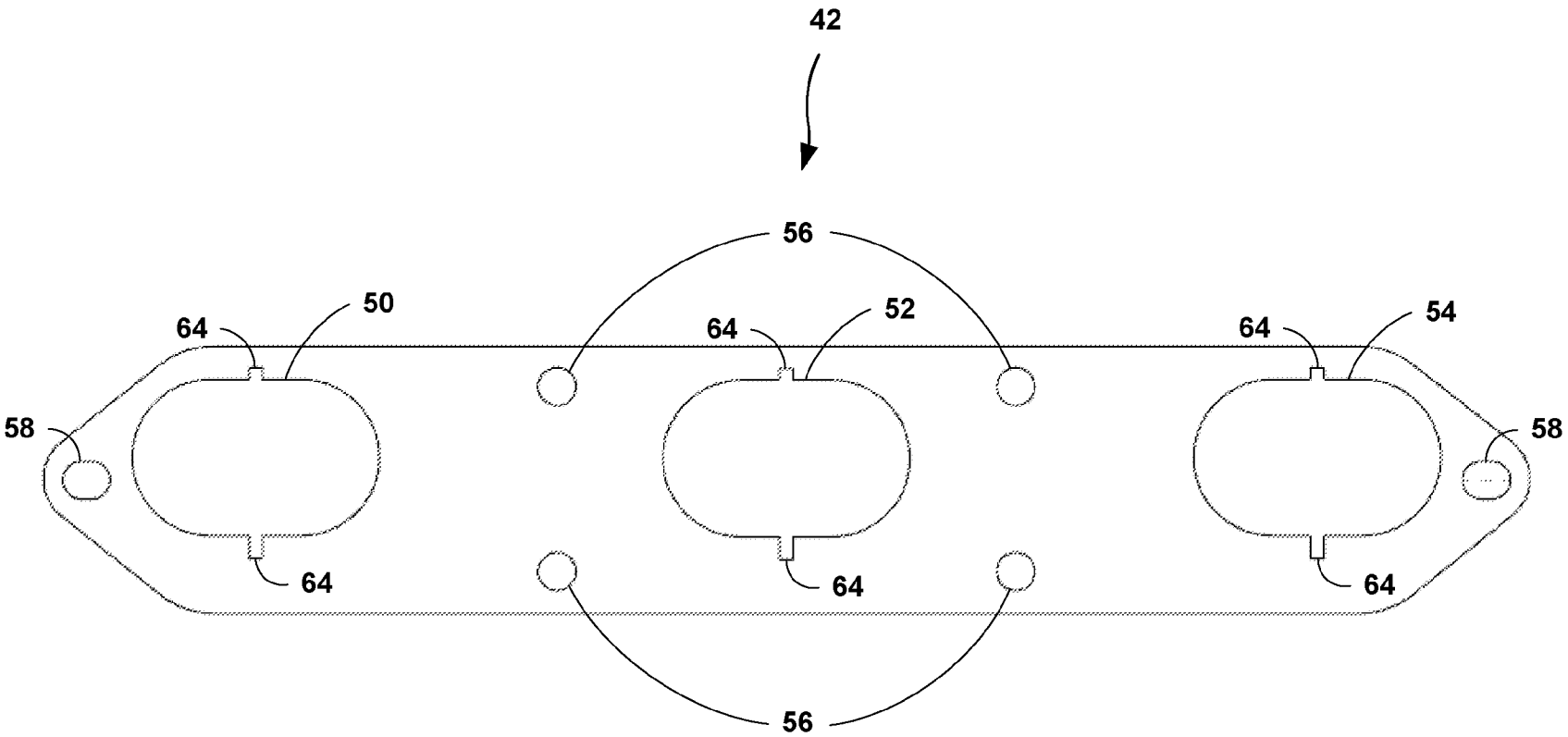
FIG. 3 is a plan view of a mounting plate of the exhaust flow divider of FIG. 2.
Figure 4:
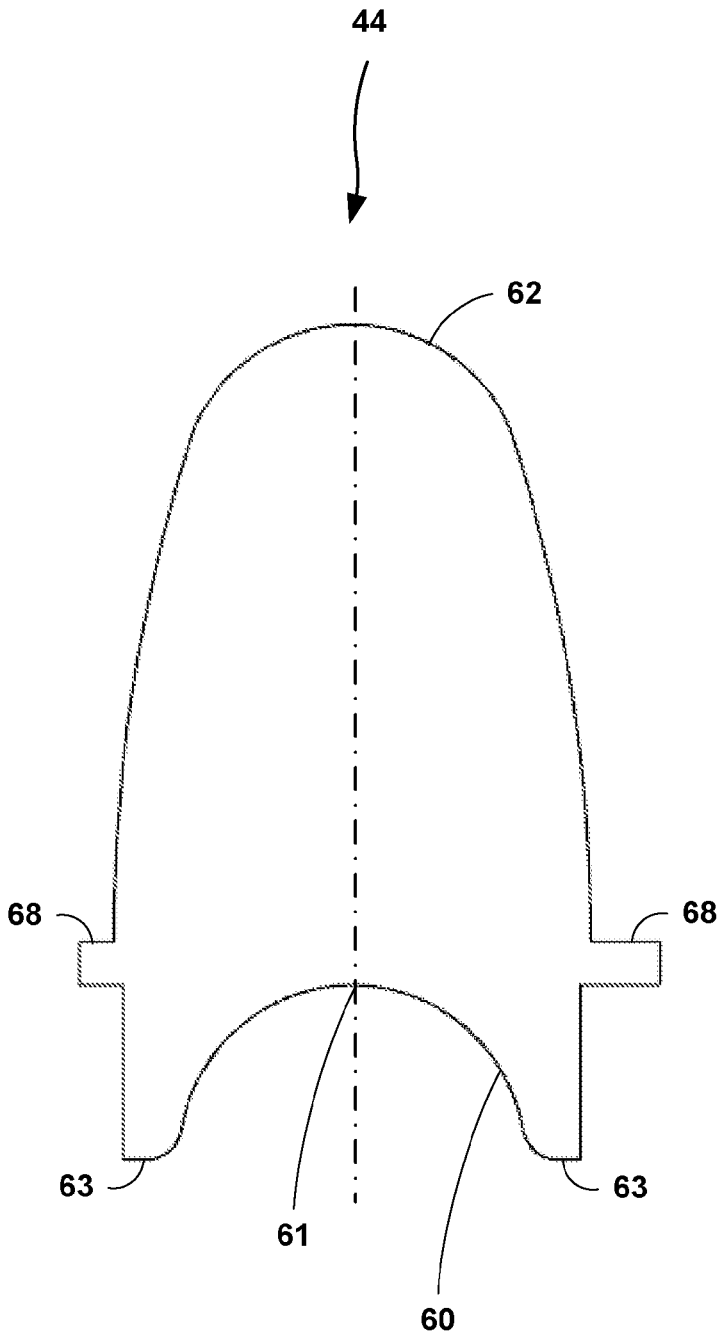
FIG. 4 is an elevation view of a flow divider plate of the exhaust flow divider of FIG. 2.

FIGS. 2-4 illustrate example exhaust flow divider 40 for use in an internal combustion engine, e.g. engine 10 of FIG. 1. FIG. 2 is a perspective view of exhaust flow divider 40 including mounting plate 42 and three flow divider plates 44*a*-*c*. FIG. 3 is a plan view of mounting plate 42 and FIG. 4 is a plan view of flow divider plate 44. In FIGS. 2-4, mounting plate 42 includes three apertures 50, 52, 54 corresponding to three flow divider plates 44*a*, 44*b*, 44*c*, respectively. Flow divider plates 44*a*, 44*b*, 44*c* are arranged to span apertures 50, 52, 54, respectively, in mounting plate 42, and, thereby, divide each of the apertures into two sides. In the example of FIGS. 2-4, exhaust flow divider 40 is configured for use with a head and corresponding exhaust manifold configured for three cylinders of an engine block, in which each of apertures 50, 52, 54 is configured to be aligned with respective apertures in the head and exhaust manifold and each of flow divider plates 44*a*-*c* is configured to extend at least two flow paths from each cylinder toward the exhaust manifold. In one example, the engine in which exhaust flow divider 40 may be used includes a six-cylinder engine and exhaust flow divider 40 is configured to be used with one bank of three cylinders of the engine. For example, exhaust flow divider 40 may be configured to be used with one bank of three cylinders of a flat or V six-cylinder engine.

In addition to apertures 50, 52, 54, mounting plate 42 includes mounting holes 56 and mounting slots 58. Mounting holes 56 and slots 58 may be configured to receive fasteners that are used to secure mounting plate 42, and, thereby, exhaust flow divider 40, between the engine head and exhaust manifold. In one example, fasteners pass through holes in manifold 34 and through mounting holes 56 and slots 58 in exhaust flow divider 40 to be received in and fastened to holes in head 14. Although example mounting plate 42 of FIGS. 2-4 includes four mounting holes 56 and two slots 58, other example mounting plates may include fewer or more holes and/or slots, as well as additional features to secure the corresponding exhaust flow divider between the head and exhaust manifold.

As noted above and illustrated in FIG. 2, flow divider plates 44*a*, 44*b*, 44*c* are arranged to span apertures 50, 52, 54, respectively, in mounting plate 42, and, in the example of FIG. 2, divide each of the apertures into two sides. Each of flow divider plates 44*a*, 44*b*, 44*c* includes two ends 60 and 62, one of which, 60, is arranged toward the exhaust manifold when exhaust flow divider 40 is assembled in the engine. The other end 62 of each of flow divider plates 44*a*, 44*b*, 44*c* protrudes away from mounting plate 42 and the exhaust manifold into a chamber within the head such that the flow divider extends at least two flow paths from each cylinder toward the exhaust manifold. In the example of FIGS. 2-4, the end 62 of each of each of flow divider plates 44*a*, 44*b*, 44*c* protruding away from mounting plate 42 includes a generally convex profile shape. However, as noted above, in another example, the end 62 of each of each of flow divider plates 44*a*, 44*b*, 44*c* protruding away from mounting plate 42 may include a generally concave shape. Additionally, in another example, the end 62 of each of each of flow divider plates 44*a*, 44*b*, 44*c* protruding away from mounting plate 42 may include a different shape that is configured to be received by saddle 46 or another flow path junction within exhaust side 14*b* of head 14. Similarly, the end 60 of each of flow divider plates 44*a*, 44*b*, 44*c* arranged toward the exhaust manifold when exhaust flow divider 40 is assembled in the engine includes a generally concave profile shape in the example of FIGS. 2 and 4, but, in other examples this end of the flow divider plate may have a differently shaped profile.

A variety of materials and manufacturing techniques may be employed to fabricate example exhaust flow divider 40. Mounting plate 42 and flow divider plates 44*a*, 44*b*, 44*c* may be fabricated from a variety of materials appropriate for use in automotive and other internal combustion engine applications, including, e.g., metals, including various steels and aluminum. In one example, mounting plate 42 and flow divider plates 44*a*, 44*b*, 44*c* are fabricated from 304 stainless steel. In one example, mounting plate 42 and/or flow divider plates 44*a*, 44*b*, 44*c* may be cut out of sheet stock employing water jet cutter, which is also referred to as a waterjet or watersaw. A water jet cutter is a tool capable of slicing into metal or other materials using a high pressure and velocity jet of water, or a mixture of water and an abrasive substance. Additional techniques and tools may be used to cut mounting plate from sheet stock, including, e.g., plasma torch cutting, manual or Computer Numerically Controlled (CNC) milling, electric discharge machining (EDM), or casting.

A variety of techniques may be employed to connect flow divider plates 44*a*, 44*b*, 44*c* to mounting plate 42. In one example, flow divider plates 44*a*, 44*b*, 44*c* are welded to mounting plate 42. Flow divider plates 44*a*, 44*b*, 44*c* may be welded to mounting plate 42 using, e.g., arc, gas, e.g. acetylene in oxygen, resistance, laser or electron beam, or solid-state welding techniques. In one example, however, exhaust flow divider 40 including mounting plate 42 and flow divider plates 44*a*, 44*b*, 44*c* may be fabricated as a single piece part, e.g. by casting.

In the example of FIGS. 2-4, mounting plate 42 includes two slots 64 for each of apertures 50, 52, 54 and each of flow divider plates 44*a*, 44*b*, 44*c* includes two tabs 66. Tabs 66 of each of flow divider plates 44*a*, 44*b*, 44*c* are configured to be received in slots 64 corresponding to each of apertures 50, 52, 54, respectively. In one example, each of flow divider plates 44*a*, 44*b*, 44*c* may then be tack welded to mounting plate 42 generally at the junction between tabs 66 and slots 64. The junction between tabs 66 of flow divider plates 44*a*, 44*b*, 44*c* and slots 64 in mounting plate 42 may act to strengthen the connection between the flow divider plates and the mounting plate and inhibit rotation of the flow dividers with respect to the mounting plate. As illustrated in FIGS. 3 and 4, one of the two slots 64 corresponding to each of apertures 50, 52, 54, and corresponding one of two tabs 66 in flow divider plates 44*a*, 44*b*, 44*c* may be smaller than the other slot and tab to prevent weakening mounting plate 42 at the edge adjacent the smaller slot. However, in other examples, all of the slots 64 may be substantially the same size. Additionally, in other examples, slots 64 in mounting plate 42 may include various combinations of varying sized slots.

Flow divider plates 44*a*, 44*b*, 44*c* may be arranged in a variety of positions relative to mounting plate 42 in different examples according to this disclosure. In the example of FIG. 2, flow divider plates 44*a*, 44*b*, 44*c* are arranged to span apertures 50, 52, 54, respectively, such that each flow divider plate divides each respective aperture into two sides. Additionally, flow divider plates 44*a*, 44*b*, 44*c* are generally perpendicular to mounting plate 42. End 60 of each of flow divider plates 44*a*, 44*b*, 44*c* is shaped and sized, in the example of FIG. 2, such that apex 61 of the cutout forming the convex end is aligned with or near a plane in which the bottom surface of mounting plate 42, i.e. the surface of the mounting plate facing exhaust manifold 32. However, in other examples, end 60 of each of flow divider plates 44*a*, 44*b*, 44*c* may be shaped and sized, in the example of FIG. 2, such that apex 61 of the cutout forming the convex end is offset from the bottom surface of mounting plate 42. For example, end 60 of each of flow divider plates 44*a*, 44*b*, 44*c* may be shaped and sized, in the example of FIG. 2, such that apex 61 of the cutout forming the convex end is aligned with or near a plane in which the top surface of mounting plate 42, i.e. the surface of the mounting plate facing exhaust side 14*b* of head 14. Additionally, in the example of FIG. 2, two nadirs 63 of the cutout forming convex end 60 of each of flow divider plates 44*a*, 44*b*, 44*c* protrude past the bottom surface of mounting plate 42. However, in other examples, two nadirs 63 of the cutout forming convex end 60 of each of flow divider plates 44*a*, 44*b*, 44*c* may be located in different relative positions with respect to mounting plate 42.

As noted above, end 60 of each of flow divider plates 44*a*, 44*b*, 44*c* may be formed differently than illustrated in the example of FIGS. 2-4. For example, the end 60 of each of each of flow divider plates 44*a*, 44*b*, 44*c* arranged toward the exhaust manifold when exhaust flow divider 40 is assembled in the engine may include a generally convex shape such that the end protrudes into the manifold. Additionally, in another example, the end 60 of each of each of flow divider plates 44*a*, 44*b*, 44*c* may be generally flat such that, in one example, there is no cutout in the divider plate defined by nadirs 63 and apex 61 and the end corresponding to end 60 in the example of FIGS. 2-4 is defined by a generally straight edge extending between two points near or at nadirs 63.

Figure 5A:
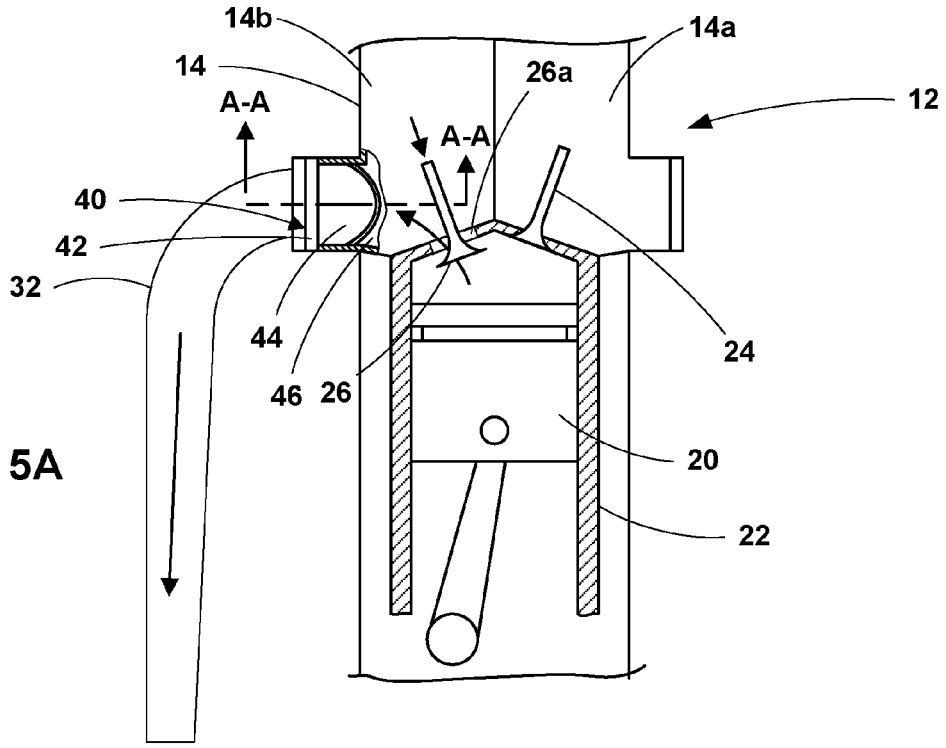
FIG. 5A is a partial section view of the engine block and exhaust manifold of the engine of FIG. 1.
Figure 5B:
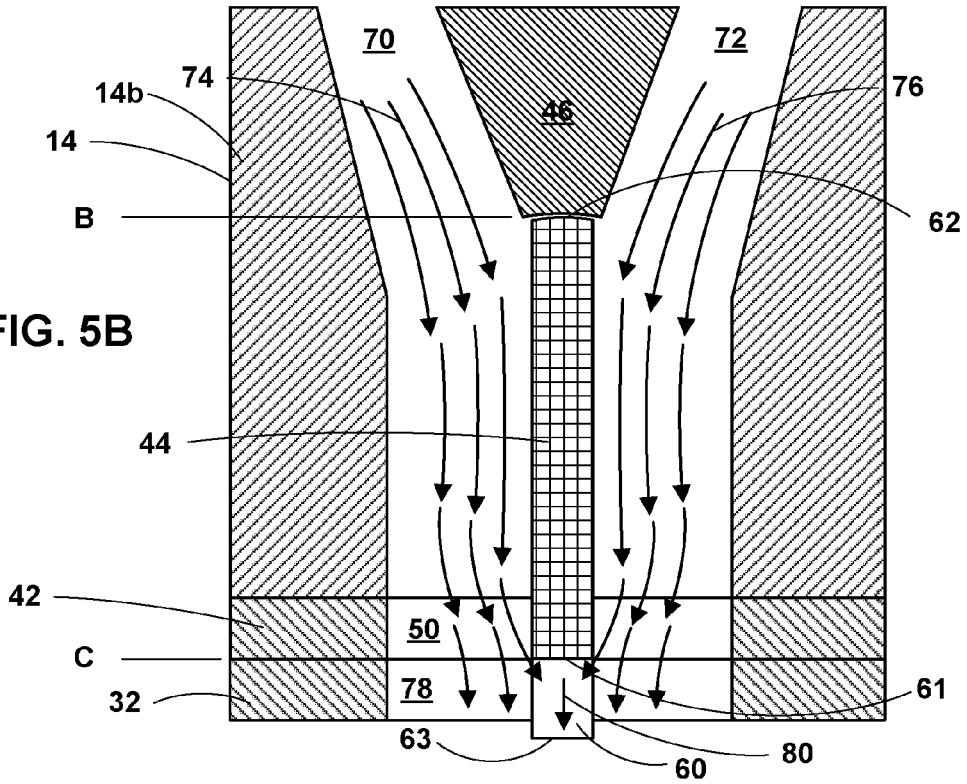
FIG. 5B is a section view of example head, exhaust manifold, and exhaust flow divider cut along section line A-A of FIG. 5A.

FIGS. 5A and 5B illustrate in greater detail the construction and function of example exhaust flow divider 40 of engine 10. FIG. 5A is a partial section view of engine block 12 of engine 10 of FIG. 1. FIG. 5B is a section view of exhaust side 14*b* of head 14, exhaust flow divider 40, and exhaust manifold 32 cut along section line A-A of FIG. 5A. In FIG. 5A, the exhaust stroke of engine block 12 is illustrated, in which piston 20 returns to an extended position farther away from the crank shaft (not shown) and closer to head 14 within cylinder 22 and exhaust valve 26 opens. As piston 20 moves to the extended position within cylinder 22, the products of combustion, i.e. exhaust are pushed out of the cylinder through an exhaust port accessible via exhaust valve 26 opening. The exhaust flows through exhaust side 14*a* of the head into exhaust manifold 32. Although not visible in the view of FIG. 5A, engine block 12 includes two exhaust valves 26 for each cylinder 22, which may be opened to allow two streams of exhaust to flow along two flow paths within exhaust side 14*b* of head 14, e.g. as illustrated in FIG. 5B.

In FIG. 5B, exhaust side 14*b* of head 14 includes two flow paths 70, 72, which correspond to two exhaust ports in cylinder 22 through which exhaust flows in two streams 74, 76, respectively, from the cylinder via two exhaust valves 26 during the exhaust cycle of engine 10. Flow paths 70, 72 of exhaust side 14*b* of head 14 are defined, in part, by saddle 46, which acts to divide a portion of the chamber within the head into two channels. However, saddle 46 only extends into the chamber within exhaust side 14*b* of head 14 as far as indicated in FIG. 5B by level B. Thus, without interposing exhaust flow divider 40 between exhaust manifold 32 and head 14 such that flow divider plate 44 extends into the chamber within the head to be received by saddle 46, the two exhaust streams 74, 76 flowing through flow paths 70, 72, respectively, would meet at level B within the head. Exhaust side 14*b* of head 14 is configured with flow paths 70, 72 formed at an angle such that when exhaust streams 74, 76 flow out of cylinder 22 into the head the two streams are flowing in partially opposing directions when they meet at level B at the end of saddle 46 within the chamber of the head. In this manner, exhaust streams 74, 76 flowing through flow paths 70, 72, respectively, may essentially crash into each other at level B at the end of saddle 46 within the chamber of exhaust side 14*b* of head 14. In some examples, allowing exhaust streams 74, 76 to meet and mix in this manner may act to induce turbulent flow within exhaust side 14*b* of head 14, which, in turn, can lead to power losses and reduced fuel economy through heat losses, back pressure, and other untoward consequences of the turbulence induced when the exhaust streams meet and mix in this manner. Therefore, examples according to this disclosure include exhaust flow divider 40, which may be configured to maintain separation between two exhaust streams 74, 76 flowing from cylinder 22 through flow paths 70, 72, respectively, within exhaust side 14*b* of head 14 until, e.g., the exhaust exits the head and flows into exhaust manifold 32.

In FIG. 5B, exhaust flow divider 40 includes mounting plate 42 and flow divider plate 44. Mounting plate 42 is interposed between exhaust side 14*b* of head 14 and exhaust manifold 32. Mounting plate 42 includes aperture 50 aligned with aperture 78 in exhaust manifold 32. Flow divider plate 44 is connected to mounting plate 42 such that the flow divider plate spans aperture 50 in the mounting plate. Flow divider plate 44 protrudes from mounting plate 42 into the chamber within exhaust side 14*b* of head 14 such that the flow divider extends two flow paths 70, 72 from saddle 46 toward exhaust manifold 32. In the example of FIG. 5B, flow divider plate 44 protrudes from mounting plate 42 into the chamber within exhaust side 14*b* of head 14 such that the flow divider extends two flow paths 70, 72 from saddle 46 into exhaust manifold 32 at level C. In other examples, however, flow divider plate 44 may protrude from mounting plate 42 into the chamber within exhaust side 14*b* of head 14 such that the flow divider extends two flow paths 70, 72 from saddle 46 not as far or further toward exhaust manifold 32 than the level C illustrated in the example of FIG. 5B. In any event, end 62 of flow divider plate 44 protruding into the chamber of exhaust side 14*b* of head 14 is shaped to be received by saddle 46. In the example of FIG. 5B, end 62 of flow divider plate 44 protruding into the chamber of exhaust side 14*b* of head 14 includes a generally convex shape and saddle 46 includes a generally concave shape. In another example, however, end 62 of flow divider plate 44 protruding into the chamber of exhaust side 14*b* of head 14 may include a generally concave shape and saddle 46 may include a generally convex shape.

By extending two flow paths 70, 72 from saddle 46 within exhaust side 14*b* of head into exhaust manifold 32 at level C, flow divider plate 44 of exhaust flow divider 40 may act to turn exhaust streams 74, 76 within the head such that the two streams are flowing in a generally parallel direction past the saddle toward the exhaust manifold. After turning exhaust streams 74, 76 within the chamber of exhaust side 14*b* of head 14 and maintaining the streams in separate flow paths 70, 72, respectively, flow divider plate 44 ends at generally concave end 60 such that the two streams meet and mix into one stream 80 as they enter exhaust manifold 32 at aperture 78. Extending flow paths 70, 72 and redirecting exhaust streams 74, 76 in this manner may act to reduce turbulent flow on the exhaust side of engine 10, which, in turn, may increase power output and fuel economy.

Figure 6:
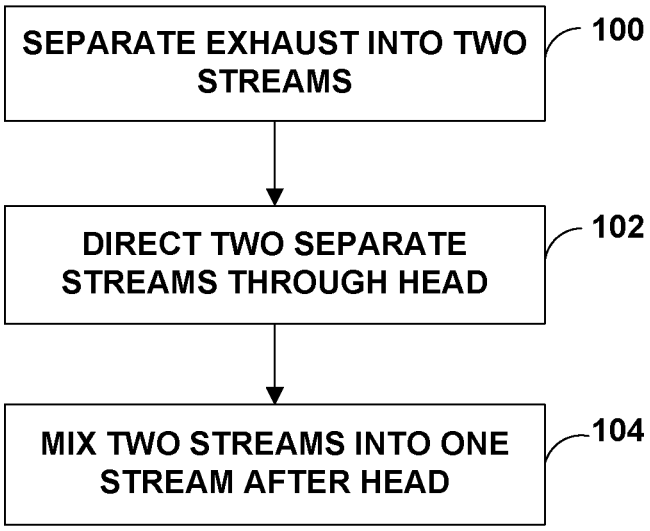
FIG. 6 is a flowchart illustrating an example method of controlling the flow of multiple exhaust streams through the head of an internal combustion engine.

FIG. 6 is a flowchart illustrating an example method of controlling the flow of exhaust through a head of an internal combustion engine. The method of FIG. 6 includes separating exhaust within a head of an internal combustion engine into two streams from two cylinder exhaust ports of the engine (100), directing the two separated exhaust streams through the head (102), and mixing the two separated exhaust streams into one stream after the two streams flow out of the head into an exhaust manifold of the engine (104). The example method of FIG. 6 for controlling the flow of exhaust through a head of an internal combustion engine are described below as carried out by exhaust flow divider 40 of FIGS. 1-5B for purposes of illustration only. However, in other examples, the method of FIG. 6 may be carried out by other exhaust flow dividers or other structures in accordance with this disclosure.

The example method of FIG. 6 includes separating exhaust within a head of an internal combustion engine into two streams from two cylinder exhaust ports of the engine (100). In one example, exhaust side 14*b* of head 14 includes two flow paths 70, 72, which correspond to two exhaust ports in cylinder 22 through which exhaust flows in two streams 74, 76, respectively, from the cylinder via two exhaust valves 26 during the exhaust cycle of engine 10. Flow paths 70, 72 of exhaust side 14*b* of head 14 are defined, in part, by saddle 46, which acts to divide a portion of the chamber within the head into two channels. However, saddle 46 may only extend partially into the chamber within exhaust side 14*b* of head 14. Therefore, exhaust flow divider 40 may be configured to maintain separation between two exhaust streams 74, 76 flowing from cylinder 22 through flow paths 70, 72, respectively, within exhaust side 14*b* of head 14.

In addition to separating exhaust within a head of an internal combustion engine into two streams from two cylinder exhaust ports of the engine (100), the method of FIG. 6 includes directing the two separated exhaust streams through the head (102). In one example, flow divider plate 44 of exhaust flow divider 40 protrudes from mounting plate 42 into the chamber within exhaust side 14*b* of head 14. End 62 of flow divider plate 44 protruding into the chamber of exhaust side 14*b* of head 14 may be shaped to be received by saddle 46. For example, end 62 of flow divider plate 44 protruding into the chamber of exhaust side 14*b* of head 14 includes a generally convex shape and saddle 46 includes a generally concave shape. In this manner, flow divider plate 40 may protrude from mounting plate 42 into the chamber within exhaust side 14*b* of head 14 such that the flow divider extends two flow paths 70, 72 from saddle 46 toward exhaust manifold 32 and thereby directs exhaust streams 74, 76 through the head.

The method of FIG. 6 also includes mixing the two separated exhaust streams into one stream after the two streams flow out of the head into an exhaust manifold of the engine (104). In one example, flow divider plate 44 protrudes from mounting plate 42 into the chamber within exhaust side 14*b* of head 14 such that the flow divider extends two flow paths 70, 72 from saddle 46 into exhaust manifold 32. After directing exhaust streams 74, 76 through the chamber of exhaust side 14*b* of head 14 and maintaining the streams in separate flow paths 70, 72, respectively, flow divider plate 44 may end at generally concave end 60 such that the two streams meet and mix into one stream 80 as they enter exhaust manifold 32 at aperture 78. Extending flow paths 70, 72 and directing exhaust streams 74, 76 through exhaust side 14*b* of head 14 in this manner may act to reduce turbulent flow on the exhaust side of engine 10, which, in turn, may increase power output and fuel economy.

Various examples have been described. These and other examples are within the scope of the following claims.

The invention claimed is:

1. An internal combustion engine comprising:

a cylinder;

a head connected to the cylinder and comprising at least two flow paths between the cylinder and the head that meet within a chamber of the head at a saddle;

an exhaust manifold connected to the head; and an exhaust flow divider comprising:

a mounting plate interposed between the head and the exhaust manifold and comprising an aperture aligned with an aperture in the exhaust manifold; and a flow divider plate connected to the mounting plate such that the flow divider plate spans the aperture in the mounting plate and protrudes from the mounting plate into the chamber within the head such that the flow divider extends at least two of the at least two flow paths from the saddle toward the exhaust manifold.

2. The engine of claim 1, wherein a first end of the flow divider plate protrudes into the chamber and comprises a shape configured to be received by the saddle.

3. The engine of claim 2, wherein the first end of the flow divider plate comprises a generally convex shape and the saddle of the head comprises a generally concave shape.

4. The engine of claim 2, wherein the first end of the flow divider plate comprises a generally concave shape and the saddle of the head comprises a generally convex shape.

5. The engine of claim 2, wherein a second end of the flow divider plate generally opposed to the first end comprises a generally convex shape.

6. The engine of claim 5, wherein the generally convex second end of the flow divider plate comprises an apex that is aligned with a first surface of the mounting plate that mates with a first surface of the exhaust manifold.

7. The engine of claim 6, wherein the generally convex second end of the flow divider plate comprises two nadirs that protrude past the first surface of the mounting plate.

8. The engine of claim 1, wherein the flow divider plate is configured to extend the at least two of the at least two flow paths from the saddle at least to the aperture in the mounting plate.

9. The engine of claim 8, wherein the flow divider plate is configured to extend the at least two of the at least two flow paths from the saddle at least to the aperture in the exhaust manifold.

10. The engine of claim 1, wherein the flow divider plate comprises two tabs protruding from two sides of the flow divider plate and received by two slots in the mounting plate.

11. An exhaust flow divider for an internal combustion engine, the flow divider comprising:

a mounting plate configured to be interposed between a head and an exhaust manifold of the engine and comprising an aperture configured to be aligned with an aperture in the exhaust manifold; and a flow divider plate connected to the mounting plate such that the flow divider plate spans the aperture in the mounting plate, wherein a first end of the flow divider plate is configured to protrude into a chamber within the head and comprises a shape configured to be received by a saddle within the chamber.

12. The exhaust flow divider of claim 11, wherein the first end of the flow divider plate comprises a generally convex shape and the saddle of the head comprises a generally concave shape.

13. The exhaust flow divider of claim 11, wherein the first end of the flow divider plate comprises a generally concave shape and the saddle of the head comprises a generally convex shape.

14. The exhaust flow divider of claim 11, wherein a second end of the flow divider plate generally opposed to the first end comprises a generally convex shape.

15. The exhaust flow divider of claim 12, wherein the generally convex second end of the flow divider plate comprises an apex that is aligned with a first surface of the mounting plate that is configured to mate with a first surface of the exhaust manifold.

16. The exhaust flow divider of claim 12, wherein the generally convex second end of the flow divider plate comprises two nadirs that protrude past the first surface of the mounting plate.

17. The exhaust flow divider of claim 11, wherein the flow divider plate comprises two tabs protruding from two sides of the flow divider plate and received by two slots in the mounting plate.

* * * * *